US009409286B2

(12) United States Patent
Hsu

(10) Patent No.: US 9,409,286 B2
(45) Date of Patent: Aug. 9, 2016

(54) SCREW REMOVAL TOOL

(71) Applicant: Yang-Ming Hsu, Changhua (TW)

(72) Inventor: Yang-Ming Hsu, Changhua (TW)

( * ) Notice: Subject to any disclaimer, the term of this patent is extended or adjusted under 35 U.S.C. 154(b) by 316 days.

(21) Appl. No.: 14/293,962

(22) Filed: Jun. 2, 2014

(65) Prior Publication Data

US 2015/0343623 A1 Dec. 3, 2015

(51) Int. Cl.
*B25B 27/18* (2006.01)
*B25B 15/00* (2006.01)

(52) U.S. Cl.
CPC ..... *B25B 27/18* (2013.01); *B25B 15/008* (2013.01)

(58) Field of Classification Search
CPC .... B25B 27/18; B25B 23/108; B25B 15/008; B25B 23/0035; B25B 15/02; B25B 23/105; B25B 13/06; B25B 13/44; B25B 13/54
See application file for complete search history.

(56) References Cited

U.S. PATENT DOCUMENTS

| | | | | |
|---|---|---|---|---|
| 5,927,165 | A * | 7/1999 | Vasudeva | B25B 15/008 81/442 |
| 6,675,679 | B2 * | 1/2004 | Dugan | B25B 13/5083 81/442 |
| 7,024,972 | B2 * | 4/2006 | Werner | B25B 13/48 81/442 |
| 7,066,062 | B2 * | 6/2006 | Flesher | B25B 13/485 411/403 |
| 2008/0190252 | A1 * | 8/2008 | Parrott | A61B 17/861 81/451 |

* cited by examiner

*Primary Examiner* — Robert Scruggs
(74) *Attorney, Agent, or Firm* — Che-Yang Chen; Law Offices of Michael Chen

(57) ABSTRACT

A screw removal tool may include a tool body, a driving unit and a tool tip, wherein the tool body has a hexagonal shaft, which is connected to a cylindrical pin at a driving end, and the cylindrical pin is connected to a block, and the pin and the block are arranged in an eccentric manner at the driving end; and wherein the driving unit has an eccentric connecting hole that mates with the cylindrical pin of the tool body and the driving unit can be rotated; wherein the tool tip has an eccentric hole that mates with the block, and pressure is applied on the block to prevent the tool tip from falling out.

5 Claims, 9 Drawing Sheets

SCREW REMOVAL TOOL

FIELD OF THE INVENTION

This invention is related to a screw removal tool, and more particularly to a tool for removing damaged or stripped screws.

BACKGROUND OF THE INVENTION

A conventional screw removal tool is shown in FIG. 11 and FIG. 12, or in FIG. 10 and FIG. 11 of U.S. Pat. No. 7,066,062, which includes a hexagonal shaft (64) and a tool tip (68). The tool tip (68) is held to the end of the hexagonal shaft (64) by a rotation pin (66) that mates with a receiving hole in the tool tip (68). The rotation pin (66) keeps the tool tip (68) in offset axial alignment with the shaft and thus the tool can be used to remove screws with stripped heads.

However, a problem with the tool mentioned above is that the shaft (68) cannot be put into a socket that is not enlarged. The tool can only be used to drive screws with stripped heads and a different tool is necessary for driving undamaged screws. Therefore, there is a need of a new and improved screw removal tool to overcome the problem stated above.

SUMMARY OF THE INVENTION

The shaft of the conventional tool cannot be put into a socket that is not enlarged and thus the conventional tool can only be used to drive screws with stripped heads.

To solve the problem stated above, the present invention provides a tool that may include a tool body, a driving unit and a tool tip. The tool body has a hexagonal shaft with six engaging faces, which is connected to a cylindrical pin at a driving end, and the cylindrical pin is connected to a block. The pin and the block are arranged in an eccentric manner at the driving end. The driving unit has a first face, a second face, six side faces, and a connecting hole that mates with the cylindrical pin of the tool body. By rotating the driving unit, the side faces of the driving unit and the engaging faces of the shaft can be aligned or unaligned. The tool tip has a first face, a second face, and six peripheral sides. An engaging hole is eccentrically formed on the first face toward the second face and the engaging face mates with the block at the end of the shaft. Pressure is applied on the block to further prevent the tool tip from falling out. Since the block and the engaging hole are both arranged in an eccentric manner, when the tool tip is secured on the tool body, the peripheral sides of the tool tip are aligned with the engaging faces of the tool body.

Comparing with conventional arts, the present invention is advantageous because (i) the tool can be used to drive undamaged screws as well as screws with stripped heads; (ii) the engaging faces of the tool body and the side faces of the driving unit can be unaligned by rotating the driving unit, and thus the tool can be used to drive screws with stripped heads; and (iii) the tool tip can prevent the driving unit from falling out and secure the screw socket so that the screw can be driven more easily.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
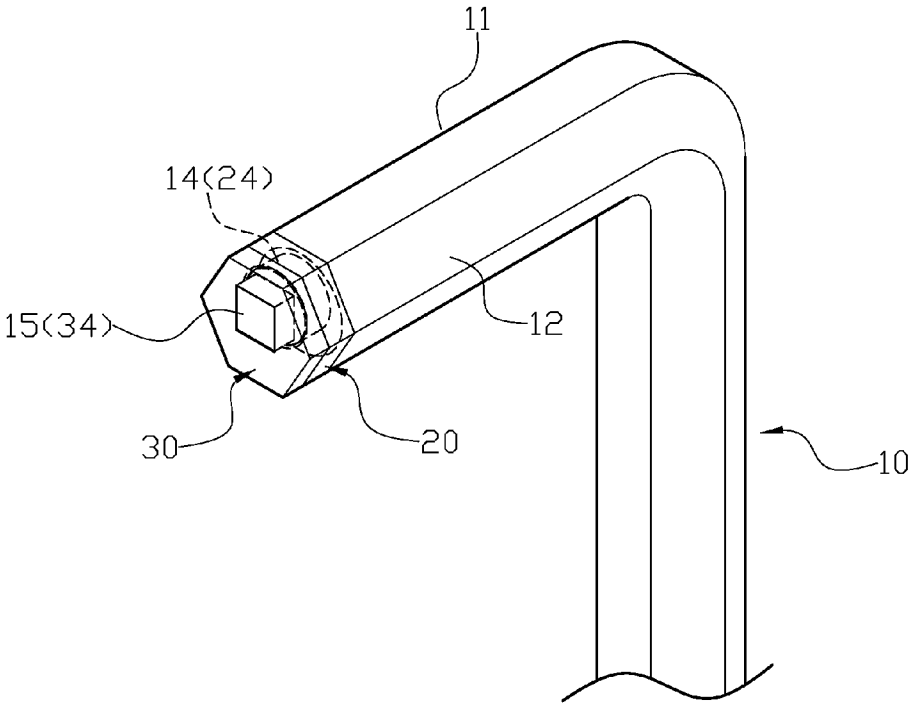
FIG. 1 illustrates a three-dimensional view of the present invention.
Figure 2:
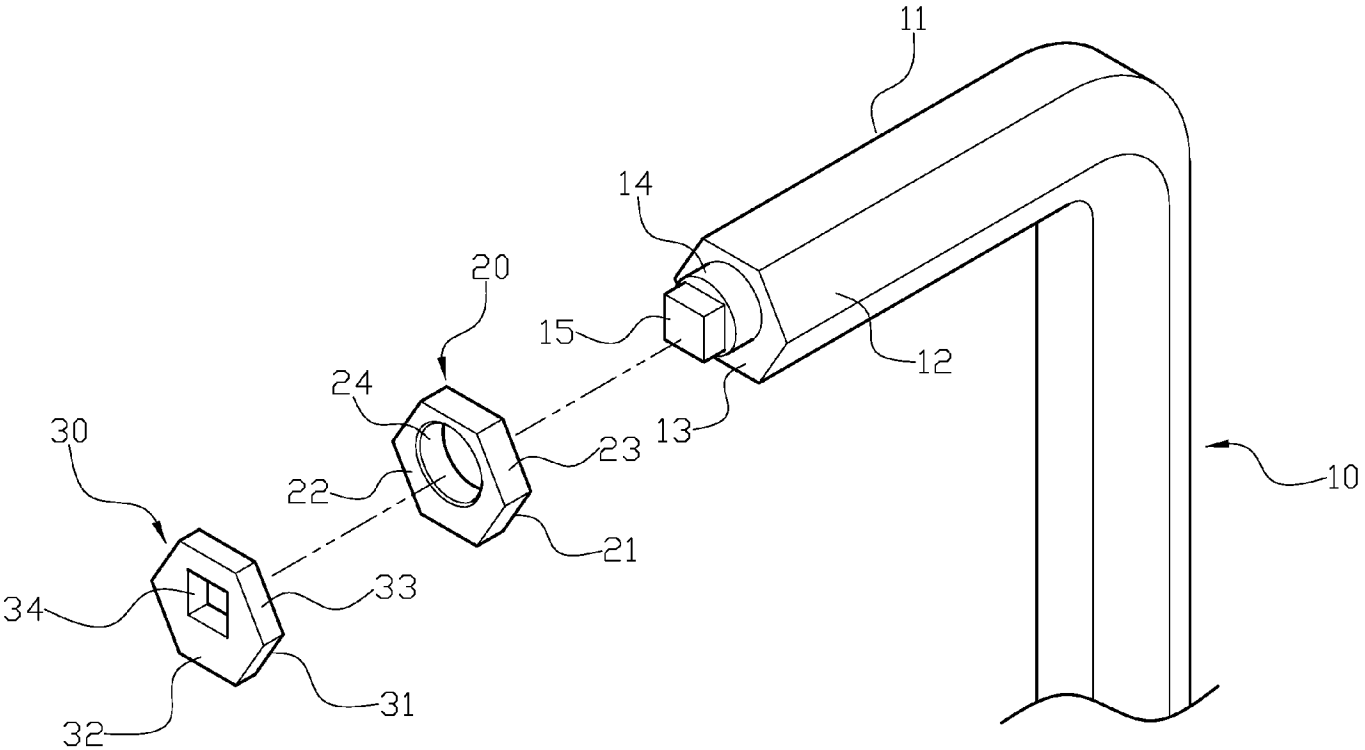
FIG. 2 illustrates a three-dimensional exploded view of the present invention.
Figure 3:
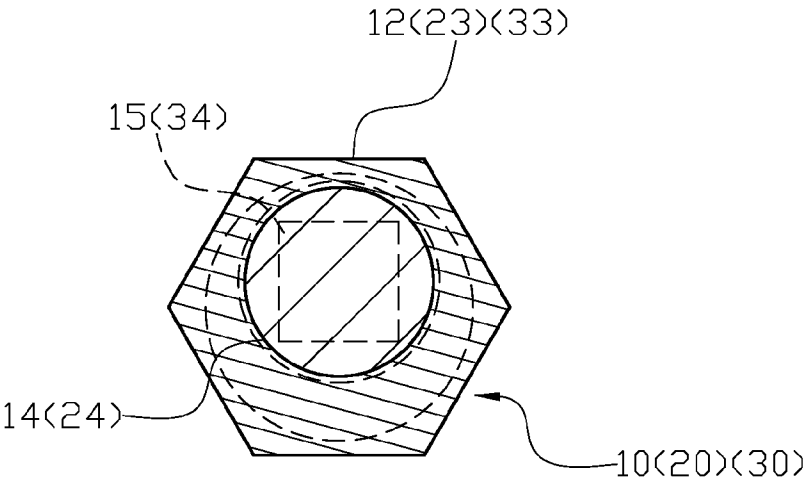
FIG. 3 illustrates a cross-sectional view of the present invention.

In order to further understand the goal, characteristics and effect of the present invention, a number of embodiments along with the drawings are illustrated as following:

As shown in FIGS. 1, 2 and 3, the tool may include a tool body (10), a driving unit (20) and a tool tip (30). The tool body has a hexagonal shaft (11) with six engaging faces (12), which is connected to a cylindrical pin (14) at a driving end (13), and the cylindrical pin (14) is connected to a block (15). The pin (14) and the block (15) are arranged in an eccentric manner at the driving end (13). The driving unit (20) has a first face (21), a second face (22), six side faces (23). A connecting hole (24) that mates with the pin (14) of the tool body (10) is eccentrically formed on the first face (21) toward the second face (22). By rotating the driving unit (20), the side faces (23) of the driving unit (20) and the engaging faces (12) of the shaft (11) can be aligned or unaligned. The tool tip (30) has a first face (31), a second face (32) and six peripheral sides (33). An engaging hole (34) is eccentrically formed on the first face (31) toward the second face (32) and the engaging hole (34)

mates with the block (15). Pressure is applied on the block (15) to further prevent the tool tip (30) from falling out. Since the block (15) and the engaging hole (34) are both arranged in an eccentric manner, when the tool tip (30) is secured on the tool body (10), the peripheral sides (33) of the tool tip (30) are aligned with the engaging faces (12) of the tool body (10).

Figure 5:
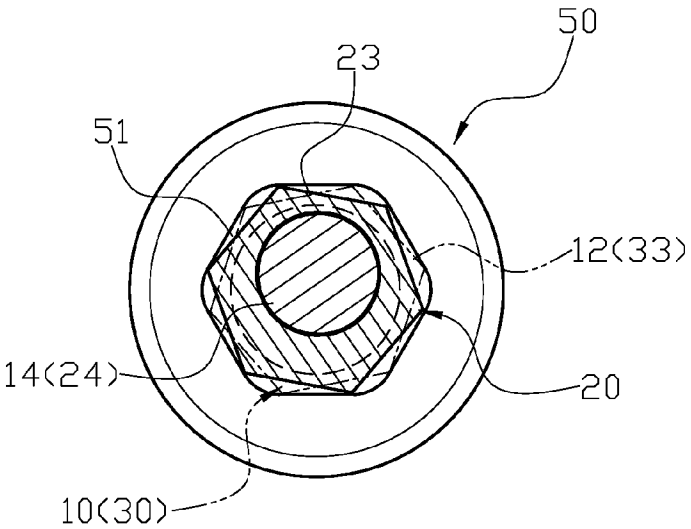
FIG. 5 illustrates another schematic view of the tool in the present invention when it is used to drive a screw with a stripped head.
Figure 4:
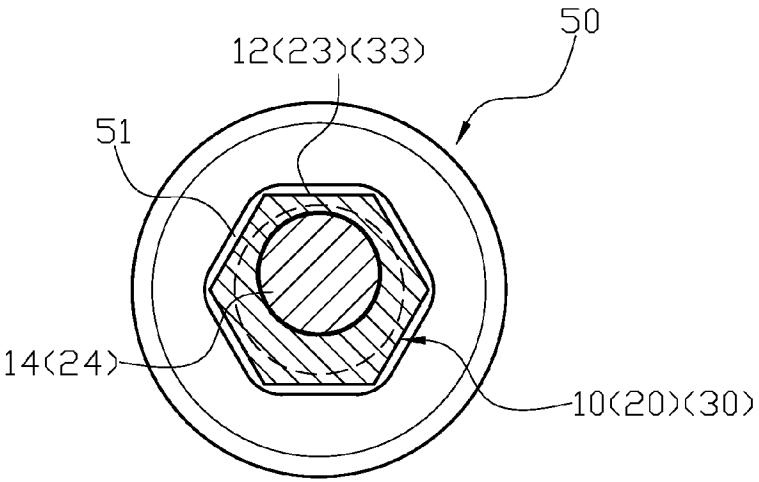
FIG. 4 illustrates a schematic view of the tool in the present invention when it is used to drive a screw with a stripped head.

Therefore, when the tool is used to drive a screw (50) with an undamaged socket (51), the side faces (23) of the driving unit (20), the engaging faces (12) of the tool body (10), and the peripheral sides (33) of the tool tip (30) can be aligned by rotating the driving unit (20). As a result, the shaft (11), the driving unit (20) and the tool tip (30) can all be put into the socket (51) and the screw (50) can be driven as regular tools. By rotating the driving unit (20), the side faces (23) and the engaging faces (12) can be unaligned and thus the present invention can be used to drive screws (50) with damaged sockets (51). As shown in FIGS. 4 and 5, when the present invention is used to drive a screw (50) with a damaged socket (51) that cannot be driven by regular tools, the rotation of the shaft will cause the rotation of the driving unit (20), and set the driving unit (20), the tool body (10) and the tool tip (30) in offset axial alignment. As a result, the engaging faces (12), the side faces (23) and the peripheral sides can secure the socket (51) simultaneously at different positions and the contact area can be increased, and thus screws (51) with damage sockets (51) can be driven easily with the present invention. The rotation of the driving unit (20) that is connected with the tool body (10) in an eccentric manner can cause significant misalignment between the driving unit (20) and the tool body (10), and thus the present invention can be used to drive screws (50) with seriously damaged sockets (51).

Figure 8:
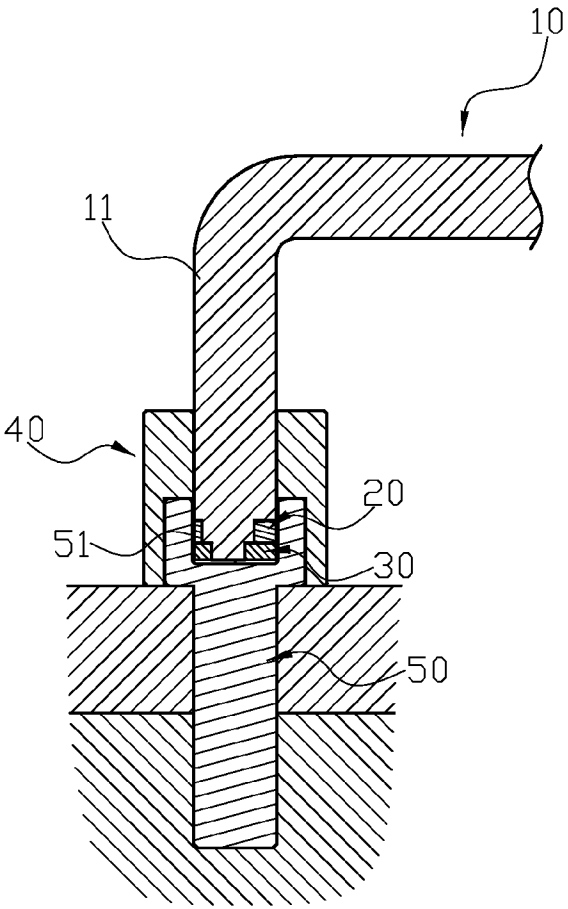
FIG. 8 illustrates a schematic view of the tool in the present invention when it is used in conjunction with a socket.
Figure 6:
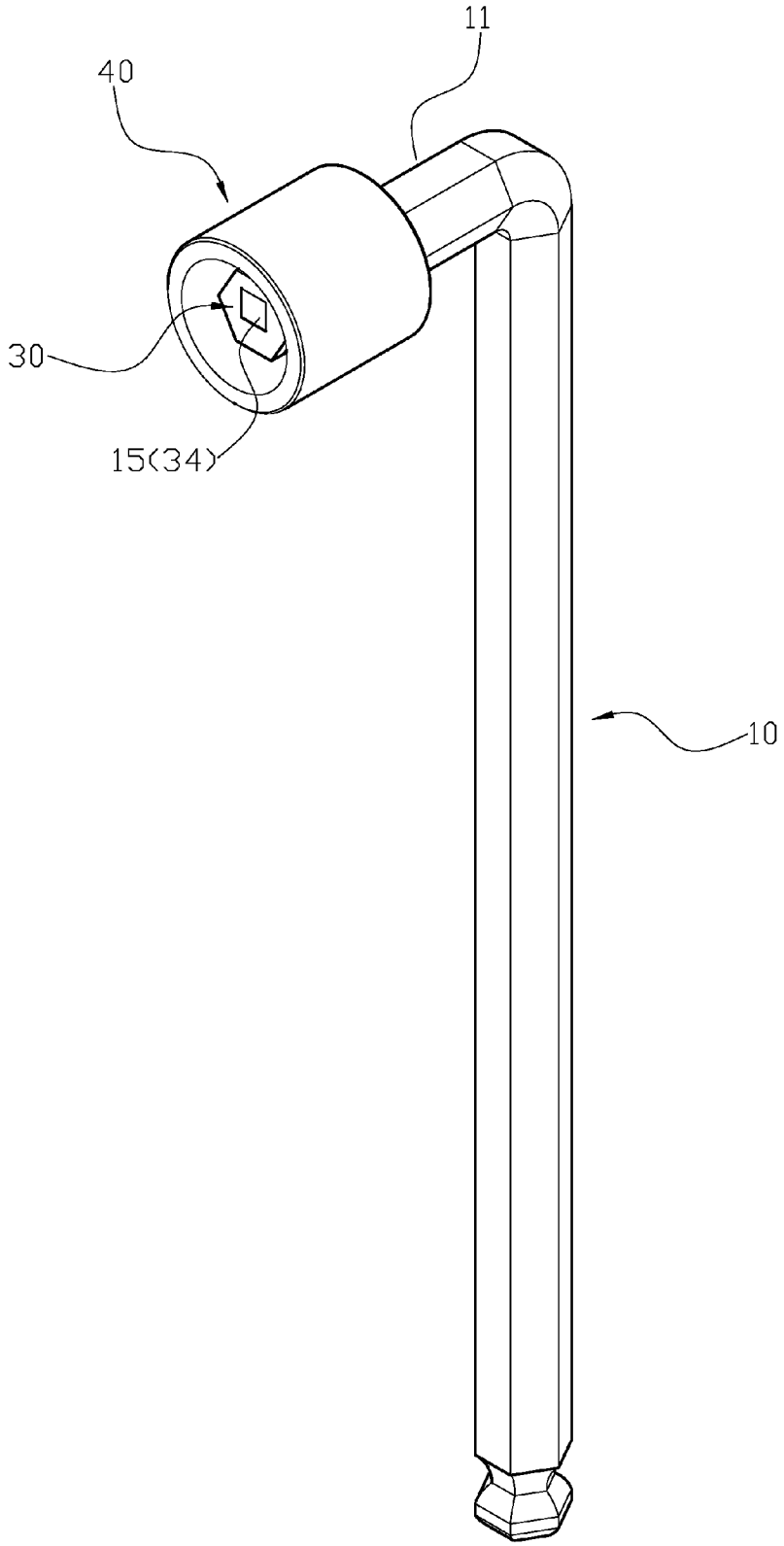
FIG. 6 illustrates a three-dimensional view of the tool in the present invention when it is used in conjunction with a socket.
Figure 7:
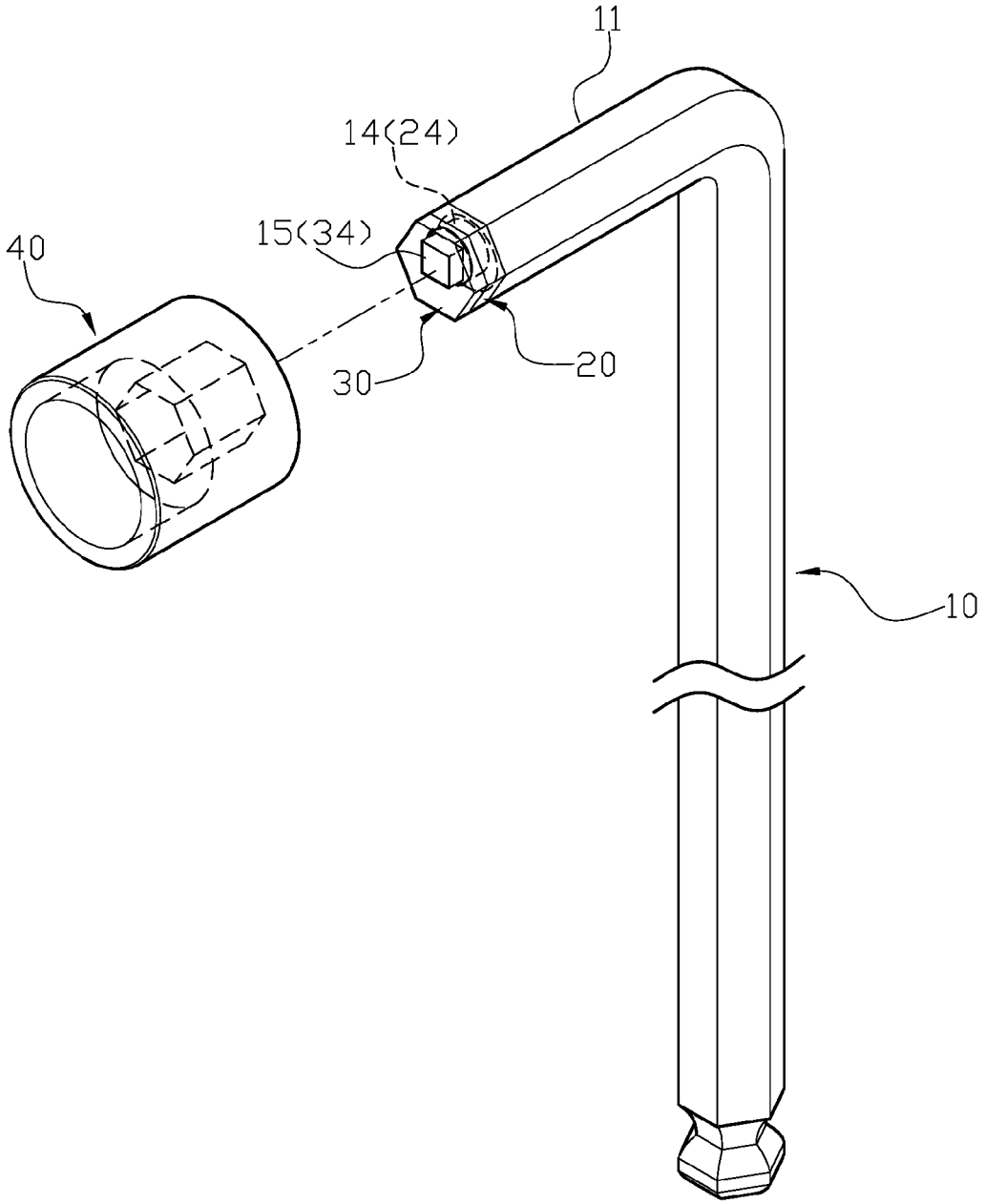
FIG. 7 illustrates a three-dimensional exploded view of the tool in the present invention when it is used in conjunction with a socket.

As shown in FIGS. 6, 7 and 8, this invention provides a tool for removing screws with stripped heads. The tool body (10) can be connected with a socket (40), which can hold the screws (50) and increase the stability of the removal process.

Figure 9:
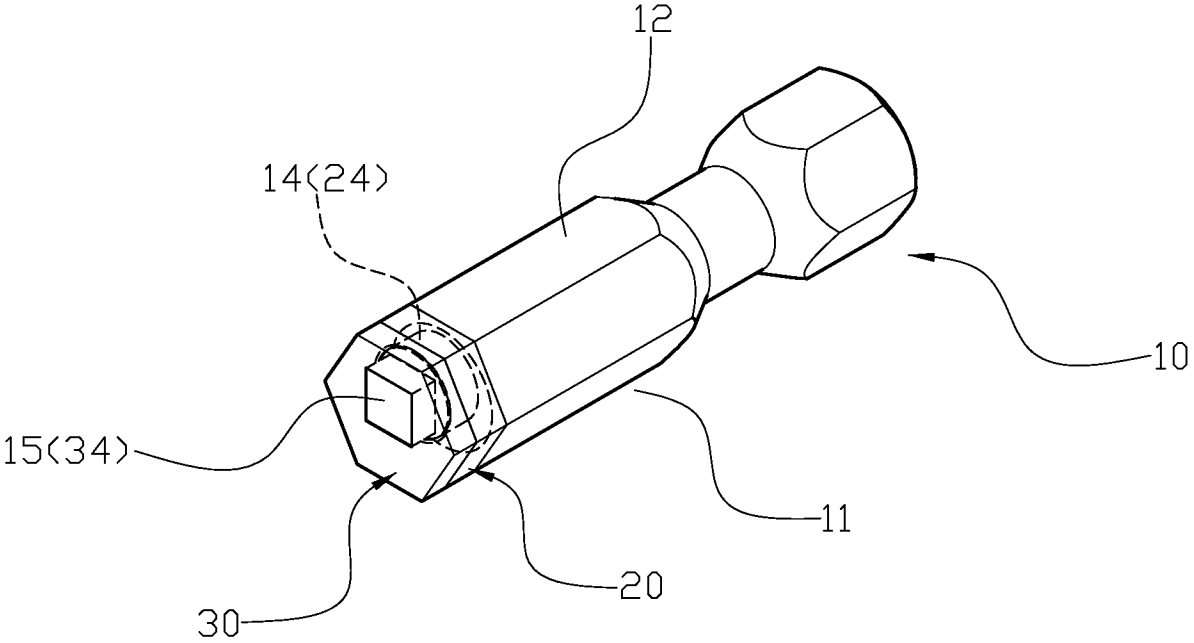
FIG. 9 illustrates another embodiment of the invention.

As shown in FIGS. 1 and 2, the shaft (11) of the tool body (10) may be made to be L-shaped. As shown in FIG. 9, a part of the tool body (10) can be used to work in conjunction with electric tools or socket spanners to drive screws.

Figure 10:
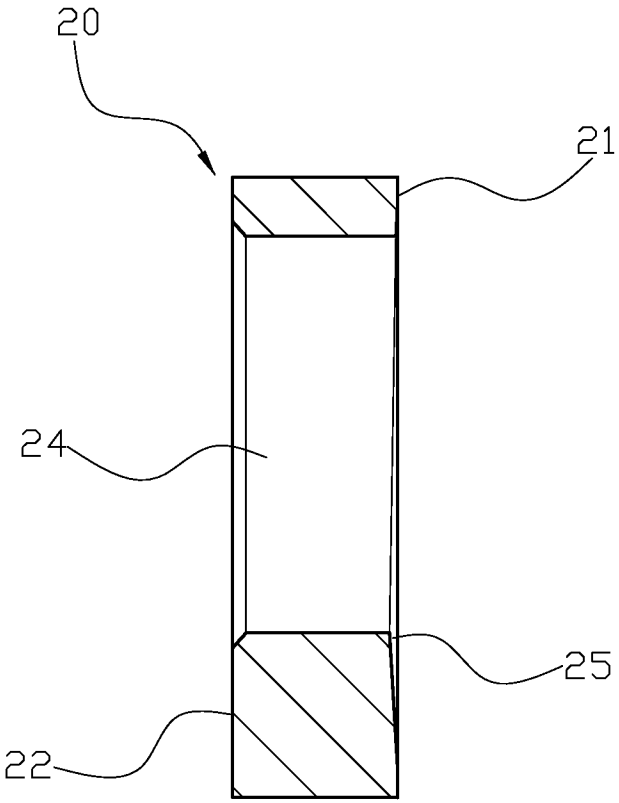
FIG. 10 illustrates a magnified cross-sectional view of the driving unit.
Figure 11:
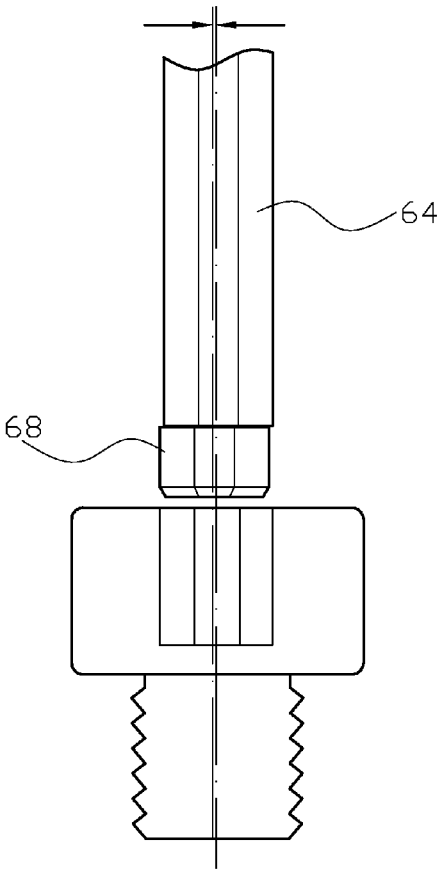
FIG. 11 PRIOR ART
FIG. 11 illustrates a two-dimensional view of the conventional tool.
Figure 12:
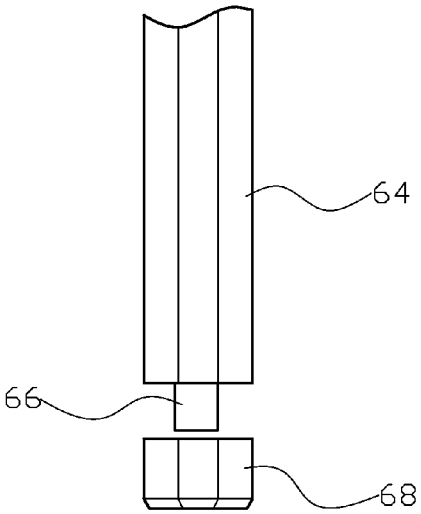
FIG. 12 PRIOR ART
FIG. 12 illustrates a two-dimensional exploded view of the conventional tool.

As shown in FIG. 10, the driving unit (20) has a dented abutting part (25) on the first face (21) that is inwardly inclined toward the connecting hole (24). The abutting part (25) touches the driving end (13), and thus the friction between the driving unit (20) and the tool body (10) can be reduced and the driving unit (20) can be rotated more easily.

According to the embodiments discussed above, the present invention is advantageous because (i) the tool can be used to drive undamaged screws as well as screws with stripped heads; (ii) the side faces (23) of the driving unit (20) and the engaging faces (12) of the tool body (10) can be unaligned by rotating the driving unit (20), and thus the tool can be used to drive screws (50) with damaged sockets (51); and (iii) the tool tip (30) can prevent the driving unit (20) from falling out and secure screw sockets so that screws (50) can be driven more easily.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A screw removal tool comprising a tool body, a driving unit, and a tool tip, wherein the tool body has a hexagonal shaft with six engaging faces, and is connected to a cylindrical pin at a driving end thereof, and the cylindrical pin is connected to a block, the pin and the block arranged in an eccentric manner at the driving end;

wherein the driving unit has a first face, a second face, six side faces, and a connecting hole that mates with the pin of the tool body and is eccentrically formed on the first face toward the second face, and by rotating the driving unit, the side faces of the driving unit and the engaging faces of the shaft are configured to be aligned or unaligned;

wherein the tool tip has a has a first face, a second face, six peripheral sides, and an engaging hole that mates with the block at the driving end and is eccentrically formed on the first face toward the second face, and pressure is applied on the block to further prevent the tool tip from falling out, and the block and the engaging hole are both arranged in an eccentric manner so that when the tool tip is secured on the tool body, the peripheral sides of the tool tip are aligned with the engaging faces of the tool body and wherein the driving unit has a dented abutting part on the first face that is inwardly inclined toward the connecting hole.

2. The screw removal tool of claim 1, wherein the tool body is used in conjunction with a socket.

3. The screw removal tool of claim 1, wherein the shaft is configured to be bent to an L-shaped object.

4. The screw removal tool of claim 1, wherein the shaft is configured to work in conjunction with electric tools.

5. The screw removal tool of claim 1, wherein the shaft is configured to work in conjunction with socket spanners.

* * * * *